United States Patent [19]

Bart

[11] 4,101,607

[45] Jul. 18, 1978

[54] APPARATUS FOR AERATING A LIQUID

[75] Inventor: Philip D. Bart, Tamarac, Fla.

[73] Assignee: PBI, Inc., Fort Lauderdale, Fla.

[21] Appl. No.: 701,643

[22] Filed: Jul. 1, 1976

[51] Int. Cl.[2] ..... B01F 3/04

[52] U.S. Cl. ..... 261/36 R; 43/56; 119/3; 210/169; 210/221 P; 261/113; 261/121 M

[58] Field of Search ..... 261/121 R, 121 M, 122, 261/123, 87, 93, 119 R, DIG. 27, 113, 62, 74, 36 R, 64 B, 59; 43/56, 57; 119/3, 5; 210/7, 169, 219, 220, 221 P

[56] References Cited

U.S. PATENT DOCUMENTS

| | | | |
|---|---|---|---|
| 2,020,536 | 11/1935 | Cox | 43/56 |
| 2,587,834 | 3/1952 | Goode | 261/121 M X |
| 2,754,617 | 7/1956 | Schwartz | 261/121 M X |
| 2,761,239 | 9/1956 | Stamps | 261/121 M X |
| 2,767,509 | 10/1956 | Breithaupt | 43/57 |
| 2,785,502 | 3/1957 | Sandness | 43/57 |
| 3,070,359 | 12/1962 | Canevari | 261/113 |
| 3,136,087 | 6/1964 | Scroggins | 43/57 |
| 3,655,172 | 4/1972 | Ingels | 261/121 R X |
| 3,864,440 | 2/1975 | Giocoechea | 261/122 |
| 3,972,145 | 8/1976 | Key | 43/57 |

FOREIGN PATENT DOCUMENTS

| | | | |
|---|---|---|---|
| 342,067 | 1/1931 | United Kingdom | 261/122 |

*Primary Examiner*—Richard L. Chiesa
*Attorney, Agent, or Firm*—Daniel M. Rosen

[57] ABSTRACT

A vessel with means for aerating a liquid therein, and particularly a bait bucket for containing water and live bait and means for replenishing oxygen in the water. The vessel has an upper chamber for containing the liquid, with a vent comprising a small aperture at the bottom of this chamber for allowing the liquid to slowly drip downward into a second closed chamber containing air or other selected gas. As the liquid occupies more of the space in the second chamber, the pressure of the gas in the lower chamber increases until a small quantity of gas escapes through the orifice, forms gas bubbles and rises through the liquid in the upper chamber. This gas flow is intermittent and will continue for many hours.

24 Claims, 10 Drawing Figures

APPARATUS FOR AERATING A LIQUID

BACKGROUND OF THE INVENTION

This invention is in the field of devices for aerating liquids, and the particular field of bait buckets for containing water and live bait with means for adding oxygen to the water by bubbling air upward through the water.

As is well known, fish in the water of aquarium tanks as well as live bait in the water of bait buckets, consume the oxygen in the water, and this oxygen must be replenished or the fish and bait will die. Where oxygenation does not occur naturally, as from underwater plant life, the standard procedure is to introduce air at or near the bottom of the water container, forcing this air to bubble up through the water, with resulting oxygenation.

With aquariums and with live-bait buckets, one well-known method of aeration is to provide an electric motor-driven or manually driven air pump for providing a flow of air into the bottom of a container of water; this air then forms into bubbles and rises through the water, and finally it escapes from the water surface to the atmosphere.

The present invention is directed particularly to a live-bait bucket, where the aeration means must be portable and should be simple, reliable, and convenient. In the prior art there are numerous devices which provide aeration but all have features which render them inconvenient, unreliable and/or expensive, as will be summarized briefly. Bait buckets with electric motor-driven air pumps require either connection to a current source which is inconvenient or impossible, or batteries which have limited power, are heavy and must be replaced periodically. Hand-driven air pumps are obviously a nuisance to the user who will often be too busy or will forget to operate such a pump. A compressed air tank constitutes an additional and heavy piece of equipment, and requires valves and ducts. Also, there are bellows systems, i.e., collapsible air spaces, whereby force upon the extended bellows or the weight of the water-filled bait bucket upon the extended bellows, collapses the bellows thereby forcing air from the bellows into and through the water in the bucket.

All of these prior art devices require specific structures having one or more undesirable features, of being bulky, expensive, complex, heavy, unreliable, and requiring frequent attention to provide adequate aeration. As disclosed herein, I have discovered a new invention which is structurally very simple and inexpensive, and provides automatic aeration for a long time period while requiring essentially no attention.

SUMMARY OF THE INVENTION

The invention disclosed and claimed herein is remarkably simple, comprising in one illustrative embodiment, an upper chamber for containing an initial quantity of water, a sealable lower chamber for containing an initial quantity of air, a partition separating said two chambers, and vent means allowing water flow downward through the vent from the upper to the lower chambers. The downward flow causes increased pressure in the lower chamber and a resulting flow of air upward from the lower chamber, through the vent means, and through the water in the upper chamber. The vent comprises a passageway between said upper and lower chambers, with one end of the passageway opening as an aperture or orifice in the upper chamber and preferably facing horizontally when the apparatus is upright with the upper chamber above the lower chamber.

It has been discovered that this downward flow of water and upward flow of air will continue slowly, for many hours, providing aeration or oxygenation of the water adequate for keeping bait such as shrimp and minnows alive in the water of the upper chamber. This invention may take a variety of forms, such as two separate upper and lower chambers instead of a single vessel having upper and lower parts; also the vent means may be a duct situated external of the chambers instead of traversing the wall between these chambers.

A more practical embodiment of the invention as described above has provision for replenishing the air in the lower chamber after this air has bubbled upward through the water in the upper chamber. In various preferred embodiments described in more detail below, there are means for conveying the water which has flowed into the lower chamber, back up into the upper chamber and simultaneously flowing air into the lower chamber, whereby the aeration cycle can continue. To convey this water from the lower chamber is a pump or a passageway through the partition, or an external duct.

At the time that the water is removed from the lower chamber there must be provision for air to enter this chamber, and one simple method is disposing a tube in the apparatus with one end exposed to the atmosphere, the other end exposed to the lower chamber and at least one of the ends being sealable during the aeration operation so that when water flows into the lower chamber the chamber pressure can rise and eventually force the air through the vent means into the upper chamber.

It should be obvious that this invention has many applications besides a self-aerating or ventilating bait bucket or as aeration means in an aquarium. It is often desired to aerate drinking water or other liquids or to purify liquids. Also, the principles and structures disclosed are applicable for introducing gases other than air or oxygen into liquids. For all these applications the structure of this invention is simple, inexpensive, small, and reliable, and requires essentially no attention, except to be sure that the lower chamber contains air, adequate at the beginning of the cycle, which can then operate for many hours unattended.

DETAILED DESCRIPTION OF THE PREFERRED EMBODIMENTS

Figure 1:
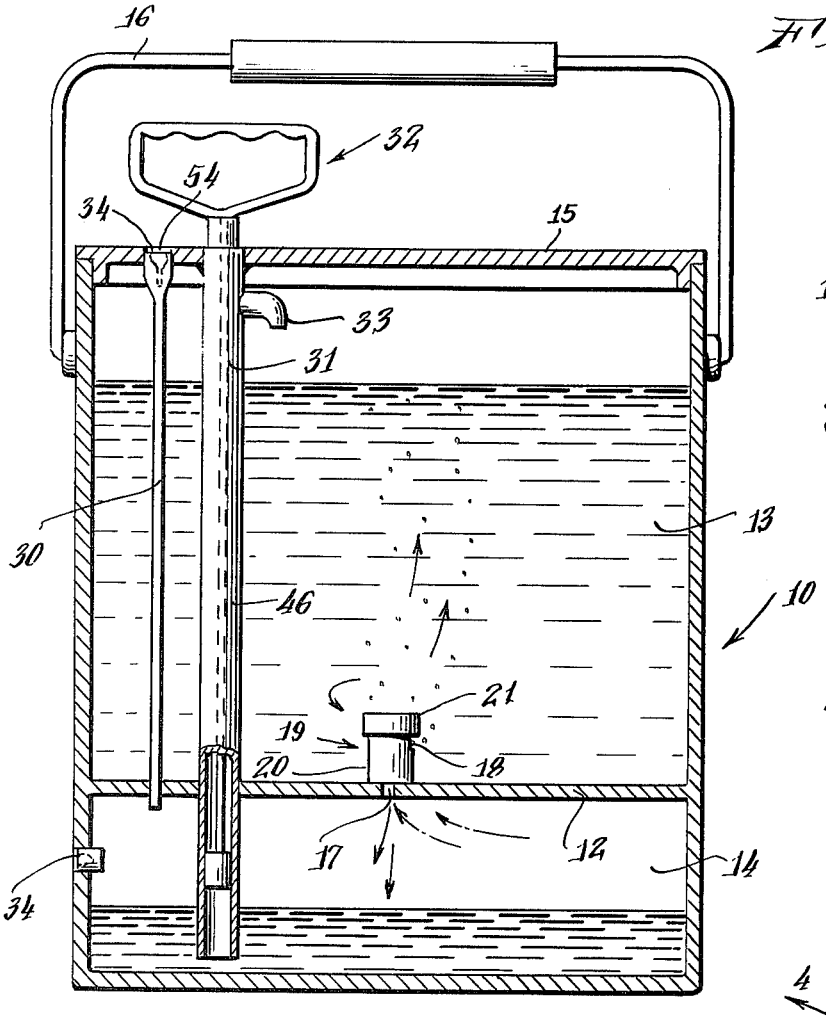
FIG. 1 is an elevation view, partially in section, showing an embodiment of my new invention.
Figure 2:
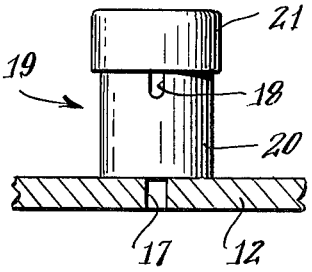
FIG. 2 is a fragmentary perspective view of the first vent means in FIG. 1.
Figure 3:
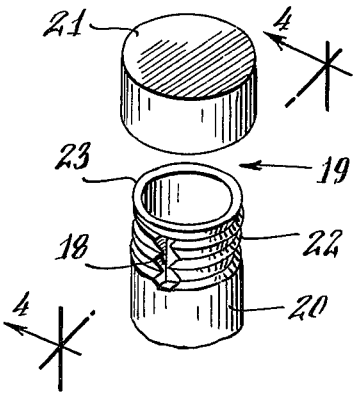
FIG. 3 is a further detail of the vent means of FIG. 1.
Figure 4:
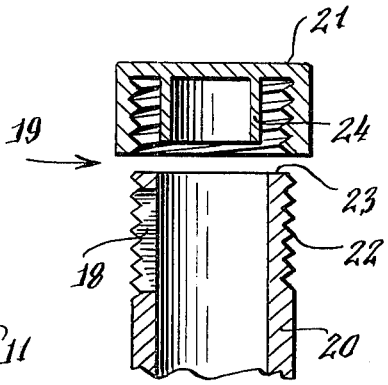
FIG. 4 is a section view of the vent means of FIG. 1.

The embodiment 10 illustrated in FIG. 1 is formed by a single vessel 11 divided by partition 12 into upper chamber 13 and lower chamber 14. For use as a live-bait bucket, this vessel 10 has a lid 15 and a handle 16. Extending through the partition between the chambers is a passageway 17 having a first end 18 or orifice opening into the upper chamber 13 and a second end opening into the lower chamber 14. The vessel in FIG. 1 is a generally round cylinder, and as shown in the detail of FIG. 2, the orifice 18 facing generally horizontally in the generally vertical wall of the venting support structure 19. The venting structure 19 is shown in greater detail in FIGS. 2–4. As illustrated, the orifice is a vertical slot 18, formed in the tube base 20. The size of the orifice is formed by turning the screw on cap 21 onto the threaded end 22 of the base 20. The slot 18 can be closed at the top as shown, or open all the way through the upper end 23 of the tube base. The inner part of the cap 21 is threaded to engage the threads 22 of the base 20, and includes a back stop tube 24 which fits over the inner side of the orifice 18 as the cap 21 is turned down onto the base 20. By turning the cap 21 in a manner causing it to close down onto the tube 20, the height of the orifice 18 is decreased. Decreasing the orifice size causes the flow of air per unit time to decrease as well, and to become more intermittent in nature, as explained below.

The embodiment shown in FIG. 1 has dimensions which were found to be very convenient and to operate very well, as follows: the bucket has a diameter of about 10 inches, with the upper chamber about 7 inches in height, the lower chamber about 3 inches in height, and the orifice about 0.04 inches in width and in height. With these dimensions, the aeration will be intermittent and last about two hours with an initial depth of 6 inches of water in the upper chamber. With the same bucket size, the orifice can range in height from 0.001 to 0.1 inches with a resulting corresponding increase and decrease in aeration times respectively. With larger openings, the air flow will be so rapid as to appear continuous. A range in height of from 0.01 to 0.05 inch is most practical, and a range of 0.02 to 0.04 inch is preferred. The wall thickness (orifice length) can be from 1/32 inch to ½ inch or more.

In operation the upper chamber 13 receives an initial quantity of water to a height of about 6 inches, while the lower chamber 14 contains only air; then the water flows slowly into the lower chamber via passageway 17 and air flows in the opposite direction through passageway 17 into chamber 13. If and when the lower chamber has received water at its 3 inch height, there will remain in the upper chamber a 3 inch column of the original 6 inch column of water, which shall be enough to at least cover the bait in the upper chamber.

Figure 5:
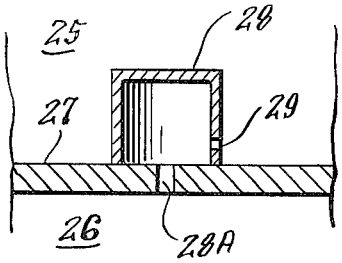
FIG. 5 is a view generally similar to FIG. 1, showing another embodiment of the vent means.
Figure 6:
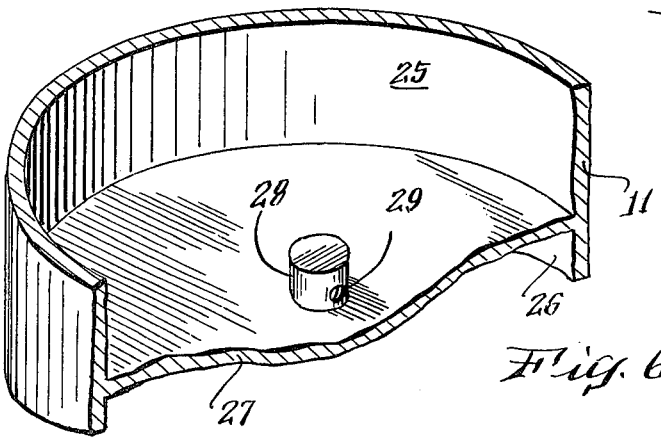
FIG. 6 is a fragmentary perspective view of the first vent means of FIG. 1.
Figure 7:
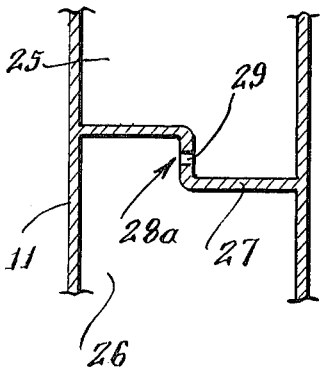
FIG. 7 is a view generally similar to FIG. 1, showing another embodiment of the vent means.

An alternative structure for providing this orifice is shown in FIGS. 5 and 6 where vessel 10 now defines upper and lower chambers 25 and 26 divided by partition 27. Vent structure 28 includes a passageway 28A extending through the partition 27, having a first end 29 facing generally horizontally.

A variety of structures are shown in FIGS. 1 and 7–10 for replenishing the air in the lower chamber, after the initial quantity of air therein has bubbled upward through the water in the upper chamber. A preferred embodiment is shown in FIG. 1.

A tube 30 passes air from the exterior of the vessel to the lower chamber 14. The tube 31 and pump 32 permit water to be pumped from the lower chamber 14 to the upper chamber 13 through the spout 33 by pumping action of the handle. A demand for air is created in the lower chamber 14 as a result of the water being pumped into the upper chamber 13. The air is drawn in through the one-way air valve 34, positioned in the mouth of the tube 30. The one-way air valve 34 is a conventional unit, known in the trade as a duck bill check valve. It is alternatively possible to satisfy the air demand in the lower chamber 14 by positioning the valve 34 in the upper part of the side wall of the lower chamber 14, as shown parenthetically in FIG. 1. Since the valve 34 operates only in one direction, release of air pressure in the lower chamber, caused by water passing from the upper chamber 13 to the lower chamber 14, can take place only back through the same orifice 18, thereby causing a periodic or intermittent air flow through the liquid of the upper chamber, thus providing the aeration effect of this invention. Variation of the orifice size varies the rate and duration of air flow.

Figure 8:
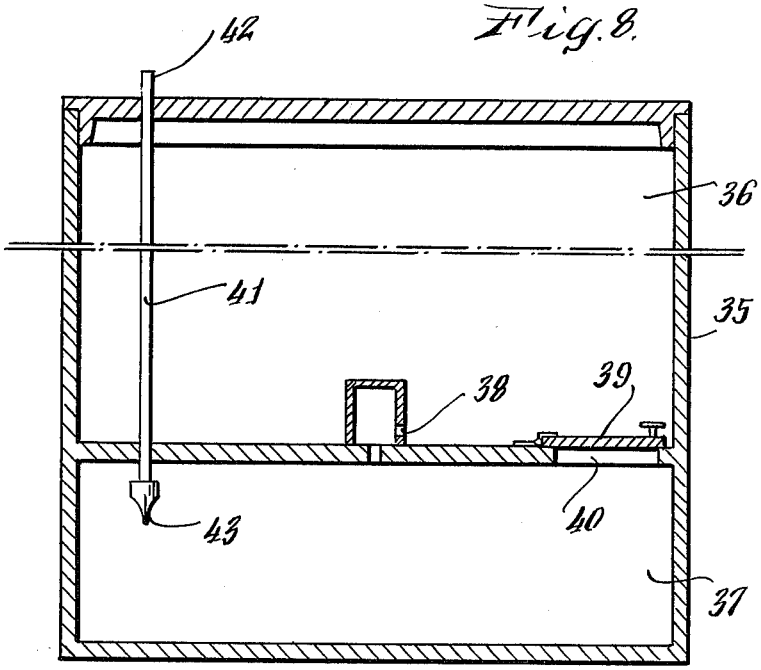
FIG. 8 is an elevation view, partially in section, of another embodiment of my invention.

In FIG. 8 the vessel 35 has upper and lower chambers 36 and 37 and first vent means 38 similar to corresponding parts of FIG. 1. When lower chamber 37 has become filled with water, the door 39 is lifted, thereby opening port 40, and vessel 35 is tipped until the water in chamber 37 has flowed into chamber 36. While water leaves chamber 37 there must be provision for air to enter this space, and accordingly, there is provided tube 41 having an upper end 42 exposed to the atmosphere and a lower end terminating with a one-way valve 43 which allows air flow only into chamber 37. Any tendency of air or water to flow upward through valve 43 will automatically close the valve. Tube 41 could alternatively extend through a side wall of the lower chamber; also the valve 43 could be installed directly in a side wall. For convenience, and to avoid confusion regarding this and the other embodiments, passageway 38 will be designated first vent means, air tube 41 will be designated second vent means, and port 40 will be third vent means.

Figure 9:
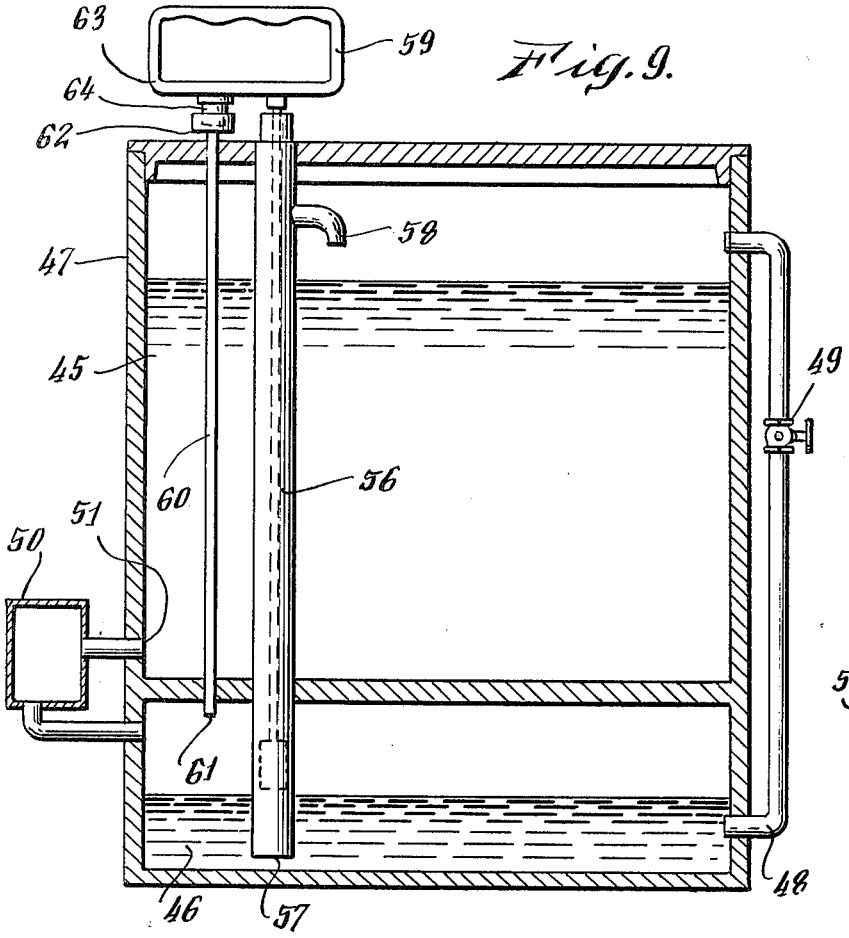
FIGS. 9 and 10 are views generally similar to FIG. 1, showing additional embodiments of my invention.

FIG. 9 shows another structure with upper and lower chambers 45 and 46 of vessel 47. Duct 48 provides a passage for water to flow from the lower chamber to the upper chamber as the third vent means. In one version element 49 represents a valve, which may be opened, and vessel 47 tipped, as described for FIG. 8 above. Alternatively, element 49 may represent a pump for forcing the water upward into chamber 45. Also shown in FIG. 9 is an external version of a first vent means 50 having orifice 51 opening into the upper chamber.

Figure 10:
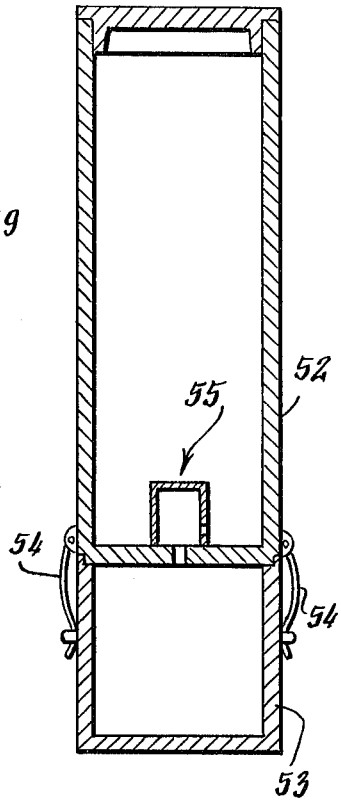

FIG. 10 shows an apparatus comprising an upper vessel 52 removably situated atop lower vessel 53, with latch means 54 for releasably securing the two vessels together. First vent means 55 is carried by the bottom wall of vessel 52. To replenish the air in vessel 53, the latch 54 is released, the vessels separated, water is poured from vessel 53 into the top of vessel 52, and the aeration cycle is restarted.

A still further embodiment of a second vent means for replenishing air in the lower chamber is shown in FIG. 9. Tube 56 is the body of a pump, having inlet end 57 for drawing water out of the lower chamber, spout 58 for discharging the water into the upper chamber, and actuator or handle 59. While water is being pumped out of the lower chamber, air is allowed to enter via tube 60 having inlet end 62 and discharge end 61. As described in FIG. 1, during the aeration cycle, at least one of ends 61 and 62 must be sealed, so that pressure can build up in the lower chamber.

This may be accomplished by arranging the handle 59 of the pump with a lateral extension 63 which joins with a pluglike member 64 for sealing the end 62 of the tube 60 when the handle 59 is in its rest position. Obviously, many other variations for sealing the tube end can be provided.

The entire chamber or container is preferably constructed of a corrosion-resistant material, such as ABS or other suitable light-weight plastic material. A styrofoam container can also be employed. The vent tubes can be built into the side walls of the container or constructed separately, also of a suitable corrosion-resistant material.

Many other variations of the structures presently shown, described and claimed herein are possible within the scope of this invention for providing automatic aeration of liquid, with the advantages over the prior art as described above.

What is claimed is:

1. Apparatus for aerating a liquid comprising a single vessel including a substantially continuous partition dividing said vessel into an upper chamber for containing an initial quantity of liquid and a quantity of unpressurized gas and positionable below said upper chamber when said apparatus is oriented in an upright manner, and first vent means for conducting said liquid from said upper chamber to said lower chamber to increase the pressure of said gas in said lower chamber and for conducting said gas from said lower chamber to said upper chamber including a passageway having a first end communicating with said upper chamber and a second end communicating with said lower chamber, whereby liquid in said upper chamber can flow by gravity slowly through said passageway into said lower chamber, thereby causing increased pressure upon gas in said lower chamber, and said gas intermittently flows upward through said passageway into said upper chamber where it forms bubbles which rise through and aerate said liquid in said upper chamber.

2. Apparatus for aerating a liquid comprising a single vessel including a substantially continuous partition dividing said vessel into an upper chamber for containing an initial quantity of liquid and a sealable lower chamber for containing an initial quantity of unpressurized gas and positionable below said upper chamber when said apparatus is oriented in an upright manner, and first vent means for conducting said liquid from said upper chamber to said lower chamber to increase the pressure of said gas in said lower chamber and for conducting said gas from said lower chamber to said upper chamber including a passageway having a first end communicating with said upper chamber and a second end communicating with said lower chamber, said first end defining an orifice of relatively small diameter which faces generally horizontally when said apparatus is upright, whereby said liquid in said upper chamber flows by gravity slowly through said passageway into said lower chamber via said first vent means, thereby causing increased pressure upon said gas in said lower chamber, and said gas flows upward through said passageway and orifice into said upper chamber where it forms bubbles which rise through and aerate said liquid in said upper chamber.

3. Apparatus according to claim 2, wherein said orifice has a diameter in the range of 0.01 to 0.05 inches.

4. Apparatus according to claim 2, wherein said orifice has a diameter in the range of 0.02 to 0.04 inches.

5. Apparatus according to claim 2, wherein said passage of said first vent means extends through said partition.

6. Apparatus according to claim 2, comprising second vent means separate from said first vent means for introducing substantially unpressurized gas into said lower chamber.

7. Apparatus according to claim 6, wherein said second vent means comprises duct means having an inlet end for communicating with a source of substantially unpressurized gas and a discharge end communicating with said lower chamber.

8. Apparatus according to claim 6, wherein said second vent means includes a one-way valve allowing gas flow only into said lower chamber.

9. Apparatus according to claim 8, operable with a source of gas wherein said valve comprises a flutter valve having an inlet communicating with said source of gas and a discharge opening communicating with said lower chamber, said valve opening only when the pressure in said lower chamber is lower than the pressure of said source of gas.

10. Apparatus according to claim 2, wherein said liquid comprises water and said gas comprises air.

11. Apparatus according to claim 10, wherein said apparatus is a live-bait bucket.

12. Apparatus according to claim 2, comprising third vent means for flowing liquid from said lower chamber into said upper chamber.

13. Apparatus according to claim 12, wherein said third vent means comprises pump means including a tube having a first end in said lower chamber and near the bottom thereof, said tube extending upward through both said chambers and having a discharge opening in said upper chamber, and manually operable actuating means external of and above said upper chamber for forcing liquid from said lower chamber into said upper chamber.

14. Apparatus according to claim 12, wherein said third vent means comprises a pump.

15. Apparatus according to claim 12, wherein said third vent means comprises a tube having an inlet end in said lower chamber near the bottom of said chamber and a discharge end in said upper chamber.

16. Apparatus according to claim 12, wherein said third vent means comprises a sealable passageway for communicating said lower and upper chambers with each other, and means for opening said passageway.

17. Apparatus according to claim 16, wherein said passageway of said third vent means is situated externally of said chambers.

18. Apparatus according to claim 2, further comprising third vent means for flowing liquid from said lower chamber through said partition into said upper chamber.

19. Apparatus according to claim 18, wherein said third vent means comprises a passageway extending through said partition and means for selectively closing and opening said passageway.

20. Apparatus according to claim 2, wherein the passageway of said first vent means comprises duct means situated external of said chambers.

21. Apparatus according to claim 2, wherein said upper chamber comprises a bottom wall and said first vent means comprises a passageway extending through said bottom wall, said passageway having one end opening into said lower chamber and a second end opening into said upper chamber.

22. Apparatus according to claim 2, wherein said upper chamber comprises a bottom wall and the passageway of said first vent means extends through said bottom wall.

23. Apparatus according to claim 22, wherein said first vent means comprises at least one wall in said upper chamber, said wall being generally vertical when said apparatus is upright, and said orifice of said second end of the passageway beingin said wall of said first vent means.

24. Apparatus according to claim 22, wherein said first vent means comprises a generally cylindrical projection situated atop said bottom wall of said upper chamber.

* * * * *